US006086484A

United States Patent [19]

Uebelhor

[11] Patent Number: 6,086,484

[45] Date of Patent: Jul. 11, 2000

[54] GOLF PUTTER HEAD

[76] Inventor: Robert N. Uebelhor, 7611 S. Meridian St., Indianapolis, Ind. 46217

[21] Appl. No.: 09/044,775

[22] Filed: Mar. 20, 1998

[51] Int. Cl.[7] ..... A63B 53/04

[52] U.S. Cl. ..... 473/251; 473/313; 473/341; 473/342

[58] Field of Search ..... 473/340, 341, 473/324, 342, 313, 314, 349, 251, 252, 253, 254, 255; D21/736–746

[56] References Cited

U.S. PATENT DOCUMENTS

| | | |
|---|---|---|
| 3,134,596 | 5/1964 | Boznos . |
| 4,199,144 | 4/1980 | Skelly . |
| 4,569,524 | 2/1986 | Quijano . |
| 4,883,275 | 11/1989 | Boone . |
| 5,078,398 | 1/1992 | Reed . |
| 5,190,290 | 3/1993 | Take . |
| 5,458,332 | 10/1995 | Fisher . |

*Primary Examiner*—Sebastiano Passaniti
*Attorney, Agent, or Firm*—Robert A. Spray, Patent Attorney

[57] ABSTRACT

A novel head for a golf putter. Its block body has a recess which extends completely from the bottom sole to the top face of the block body, the recess having side faces and a forward-facing back face.

A supplemental body, which is formed from a material which is substantially lighter in specific gravity than the specific gravity of the remainder of the block body, fills the recess, extending between the side faces of the recess, and forwardly from the back face of the recess completely forwardly of the block body, providing the hitting surface in hitting the ball.

Other features are provided.

16 Claims, 3 Drawing Sheets

GOLF PUTTER HEAD

I. FIELD OF THE INVENTION

The present invention relates to golf equipment, and more particularly to golf clubs of a special form for particular use in effecting a putting stroke; and such clubs are commonly known as putters.

Although not limited to putting strokes, putters generally have the particular function of a relatively light stroke for imparting energy to cause the ball to receive enough energy to travel a relatively short distance on the generally smooth surface of the putting green which contains the hole as a specific target.

Accordingly, in contrast to other golf clubs, putters are desirably formed for achieving a quite precise travel of a ball with respect to both distance and direction, by a stroke which is restricted and precisely aimed.

II. PROBLEMS INHERENT AS TO THE PROVISIONS OF A GOLF PUTTER

Several inherent particulars of the use of a putter club provide problems which must be solved to make any particular overall construction of a putter head desirable.

For example, it must be quite accurate in construction for achieving accuracy of effect, a high degree of accuracy to consistently and confidently achieve the intended purpose.

Thus, the overall weight must be such that the combination of the putter head and its carrying shaft gives a desirable "feel" to the user as the putter is used for shots of varying amounts of length, green slope, green texture, etc.

As is mentioned herein, the putter must desirably have enough reasonableness of looks and feel as to give the user maximum confidence, even though this factor is so subjective to the particular user as to make it a matter of some uncertainty as to any of the several particulars of club design.

Moreover, the matter of confidence in use seems to be such a fanciful and illusive factor that even skilled golfers disagree with others, and even disagree with their own selves, from time to time, as to the help which individual characteristics of the putter club actually are and contribute to the overall achievement.

As a practical matter, the putter head design has to be in realization of the fact that, for confidence or whatever other attribute the putter head itself seems to convey, the characteristics which are both visible and "feelable" to the user, must be such as to impress the user as a potential purchaser and contribute to the user's subsequent use of the putter in the actualities of practice and of the challenge of the golf play itself.

III. SUMMARY OF THE INVENTION

Toward the end of satisfactorily meeting and solving the various problems of putter head design, the inventive concepts here relate to the club body and to a supplemental body, and to their relationship one to the other.

More particularly, the inventive concepts provide that the block body has a recess formed in the block body; and the recess extends completely from the bottom sole to the top face of the block body. The block body is formed to provide side faces of the recess and a forward-facing back face of the recess.

The recess carries a supplemental body which is formed from a material which is substantially lighter in specific gravity than the specific gravity of the remainder of the block body.

The supplemental body fills the recess; i.e., it extends between the side faces of the recess, and it extends forwardly from the back face of the recess completely forwardly of the block body providing a hitting surface in hitting the ball.

Other details are specified herein.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively help to show the non-obviousness of this combination invention. E.g., a. The prior art has had several decades of invention and development of golf putters, and the countless attempts and improvement have been made; and a showing of the energetic developing activity through the years is shown merely by the many putters advertised commercially, most claiming a specific one or more improvements, as represented by this illustrative listing: Anser; B; Ballnamic; Blue Goose; Brittany; Bulls Eye; Calloway; Chancellor; Cleveland Classis; Crenshaw; Danish; Dead Center; Emperor; Gentle Ben; George Low Wizard; Gwen; Inertial; Jackson Lee; Jay Bird; John Schlee; Katlyn; Link-Master; Lizzy Beth; Lynx Parallax; MacGregor; Musty; Natural; Noble; O Moody; Odessey; Pal; Palmer; Pharoah; Ping; Pole Cat; Positive; Poz; Ram; Ray Cook; Redwood City; Response; Revealer; Scottsdale; Slotline; Smoothie; Sonia; Spald Tour; Spalding; Sweet Roll; Sweetheart; T. P. M.; T. P. Mills; Tad Moore; Target Line; Taylor Made; Teardrop; Techline; Thor; Tiffany; Titleist; Tommy Armour; Troy; Tsar; Traditional; Wilson; Wild Mountain; World Putting; Zapp; Zebra; and Zing.

b. Such a huge number of variations of these putter devices help to show that the novelty here is to be considered as inventive, for they show that this may be considered as quite a "crowded art"; and especially is this consideration logical when it is noted that putters are such "simple" things from the standpoint of their simplicity of construction.

c. More particularly, putters may be considered simply as "L-shaped tools", having no moving parts, and having only a very specific use; and yet through the years the inventive minds have sought to create the ideal putter by developments relating to the most minute construction features of putters, that is, each of the many features of; material density; head formations; one or more materials (wood, brass titanium, copper, aluminum, etc.); precision of balance; size and location of what is considered to be a "sweet spot"; alignment details; relative location of the neck or hosel; casting procedures; flanges and weights; blade or mallet shape; provision of instancy of rolling effect; balance of face; milled face supposedly providing "gear grip action"; weight distribution; offsetness of neck or hosel; "feel" and "touch" details; distinctiveness of appearance by shape and surface ornamentation; nature and location of recesses; supposed stability of putter sole; hosel features; various rear details; lie and loft details; supposed smoothness of stroke incentive; squareness of blade as stroked; supposed on-line travel of the ball; pendulum swing effect; consistency of effect; "solidness of feel"; nature of aiming lines; minimization of "ricochet and hop"; inertia of weighting system;

aspect of center of gravity to point of impact; "softness of feel as sensed";

curvature of face; "dual radius" nature of head face; rotatable sole; plastic-filling of the head; gooseneck nature of neck or hosel; "unit-cell" head construction; in-line aiming and directional control capabilities; peripheral details; counterbalancing of head; relation of tail section to toe section to yield an increased static moment for making face having tendency to stay square to the swing path; forwardly offset portion above the head to enable observation of golf ball and putter face at address and as the putter face approaches and strikes the ball; and face plate nature; etc.

d. All of the various attempts and changes illustrate not only the attempts but the unique problems of putter head desiqn; and all of the efforts to make the "ideal" putter are realistically encumbered by the fact that no one seems to know for sure what is the critical factor or factors involved.

e. The increasing growth of golf as a pastime has shown that there are an increasing number of persons and manufacturers who would be supposed to be quite willing to deal in putter improvements;

f. Putters, in contrast to other golf clubs, are not generally considered a part of an inter-related set of clubs, and thus more golfers would be supposed to be potential customers of putters than the lesser number who would be likely to be in the market to purchase an entire set of replacement clubs;

g. The relative simplicity of putters, as an item of construction, has surely given manufacturers ample incentive to have made modifications for commercial competitiveness in a competitive industry with huge sales prospects reasonably expectable;

h. The prior art has always had sufficient skill to make many types of putters, more than ample skill to have achieved the present invention, but only if the concepts and their combinations had been conceived;

i. Substantially all of the operational characteristics and advantages of details of the present invention, when considered separately from one another and when considered separately from the present invention's details and accomplishment of the details, are within the skill of persons of various arts, but only when considered away from the integrated and novel combination of concepts which by their cooperative combination achieves this advantageous invention;

j. The details of the present invention, when considered solely from the standpoint of construction, are relatively simple, and the matter of simplicity of construction has long been recognized as indicative of inventive creativity;

k. The prior art has shown that it is willing to use and undertake developments of various factors of putter head design;

l. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate;

m. The prior art has long had mechanisms and production equipment of various kinds which could produce all of the particulars of the present invention;

n. With increasing intensity of golf as a universal pastime, and with the likelihood that many golfers would be willing to purchase a replacement putter in contrast to individual other clubs or club-sets, the likelihood of huge sales prospects is magnified;

o. The cost of manufacture of a putter, even including the extra cost of two-unit type, is sufficiently low as to be within the marketability or supposed-marketability in this aggressive industry;

p. It is generally believed that many or most golfers are persons of pride or hopeful pride in their golfing skills, and the matter of an improved putter would be particularly an incentive to purchase, as most golf equipment manufacturers would surely believe and promote;

q. Accordingly, although the prior art has had capability and motivation, amply sufficient to presumably give incentive to the development of specialized golf putters according to the present invention, the fact remains that the present invention awaited the creativity and inventive discovery of the present inventor. In spite of ample motivation and capability shown by the illustrations herein, the prior art did not suggest this invention.

V. PRIOR ART FACTORS, AS PARTICULAR INSTANCES OF FAILURE TO ACHIEVE THE PRESENT CONCEPTS

In view of all of these factors of capability and motivation, it may be difficult to realize that the particular combination of the two-unit basic construction has not been conceived, even though the golf equipment industry development is quite commercial and competitive. Further, the persons of sufficient knowledge and skill to have achieved this combination surely include a multitude of manufacturers and users of golf club putters of various designs, such that this combination invention would have come about if its concepts had been obvious.

Some recent prior art which has come to the attention of this inventor after his invention is illustrated by the voluminous types of developments of golf putters through the decades, as already illustrated.

Search efforts have shown the prior art as illustrated in the following U.S. Patents and ones cited therein:

| | | |
|---|---|---|
| Antonious | 4,826,172 | 1989 |
| Finney | 4,995,612 | 1991 |
| Antonious | 5,011,151 | 1991 |
| McNally, et al. | 5,026,056 | 1991 |
| Gorman | 5,048,834 | 1991 |
| Gorman | 5,048,835 | 1991 |
| Finney | 5,060,950 | 1991 |
| Gorman | 5,074,563 | 1991 |
| Solheim | 5,193,805 | 1993 |
| Kranenberg | 5,439,222 | 1995 |
| Schmidt (Callaway) | 5,460,377 | 1995 |
| Jimenez | 5,494,288 | 1996 |
| Rife | 5,562,551 | 1996 |
| Besnard, et al | 5,643,112 | 1997 |
| Gutherie | 5,700,207 | 1997 |

Without implying thoroughness, all of this prior art through the years illustrates the long-continuing inventorship and developments, but none shows or suggests the present invention.

VI. SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's present creativity.

More particularly as to the novelty here of the invention as considered as a whole, the candid reference to the prior art uses and needs helps to show its contrast to the present concepts, and emphasizes the advantages, novelty, and the inventive significance of the present concepts as are here shown, particularly as to salability, characteristics of use in practice and actual play, and confidence of use.

Moreover, prior art articles known to this inventor which could possibly be adapted for this duty fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts. Thus, as shown herein as a contrast to all the prior art, the inventive significance of the present concepts as a combination is emphasized and the nature of the concepts and their results can perhaps be easier understood.

Although varieties of prior art are conceded, and ample motivation is shown and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a combination device achieving the combination of confident feel and accuracy in use, and other advantages of the present invention, which are goals only approached by the prior art, must be recognized as showing a long-felt need fulfilled.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VII. BRIEF DESCRIPTION OF THE DRAWINGS

The above description of the novel and advantageous invention is of somewhat introductory and generalized form. More particular details, concepts and features are set forth in the following and more detailed description of the preferred embodiment, taken in conjunction with the accompanying Drawings which are of somewhat schematic and diagrammatic nature for showing the inventive concepts.

VIII. DETAILS OF ILLUSTRATIVE EMBODIMENT

Figure 1:
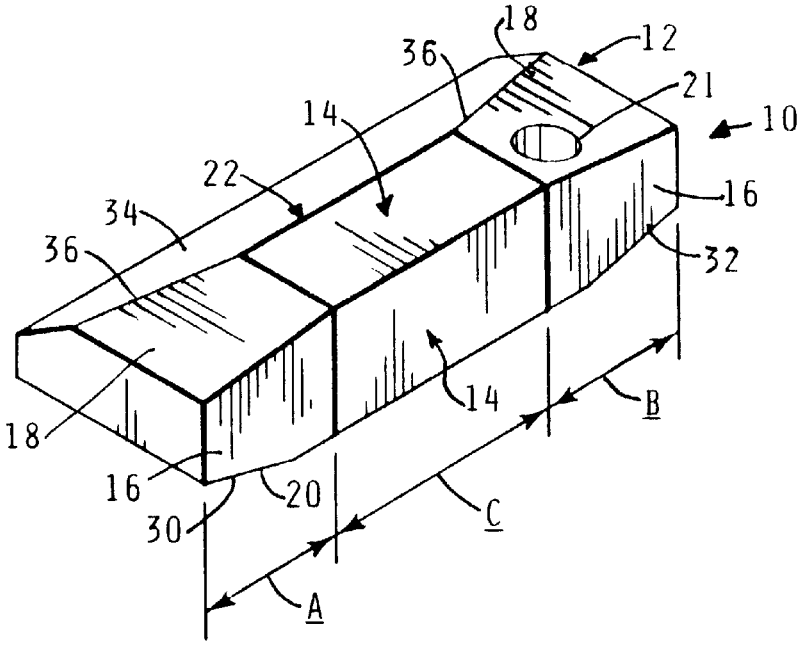
FIG. 1 is a pictorial view of a putter head according to the present invention.

As shown in the Drawings, the golf putter head 10 is basically of two-body construction, having faces and portions as detailed herein, the two bodies being referred herein as d block body 12 and a supplemental body 14.

The block body 12 has faces including a front face 16 (in two portions as designated herein), a top face 18 (also in two portions as designated herein) and a bottom sole 20. A hole 21 is for receiving a neck or hosel of the club's shaft.

Figure 2:
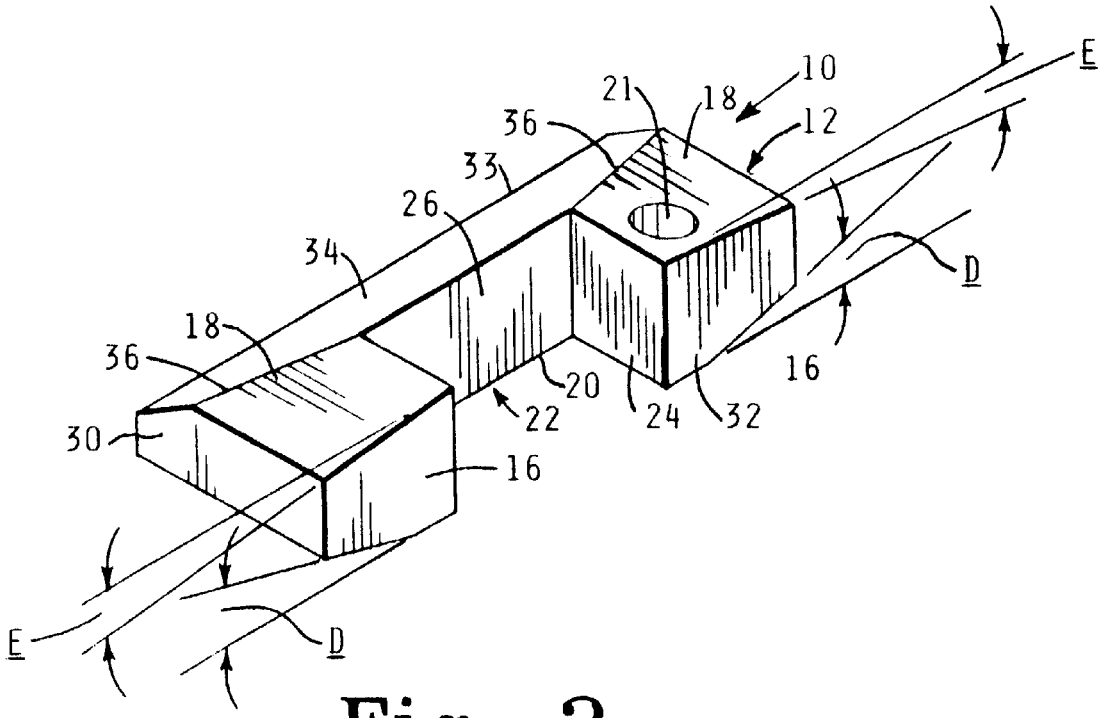
FIG. 2 is a pictorial view of the putter head of FIG. 1, but showing the supplementary body removed to show the interior of the principal block body.

The block body 12 is shown as having provided therein d recess 22 formed in the block body 12, which recess 22 (see FIG. 2) extends completely from the bottom sole 20 to the top face 18 of the block body 12.

That recess 22 is shown as providing side faces 24 opposite one another and a forward-facing back face 26 of the recess 22.

It is within this recess 22 that the supplemental body 14 is carried between the side faces 24 of the recess 22; and the supplemental body 14 extends forwardly from the back face 26 of the recess 22, the supplemental body 14 extending completely forwardly of the block body 12 and its front face 16 to provide a hitting surface which is operatively engageable against the associated ball being struck.

The supplemental body 14 is formed from a material which is substantially lighter in specific gravity than the specific gravity of the remainder of the block body 12. Advantageously, this provides that the center of gravity of the overall club head 10 is rearwardly of the geometric center of the head 10, and provides that the toe 30 and heel 32 portions of the body 12 are providing most of the weight of the head 10, all appearing to improve hitting accuracy.

It would be noted that the fore-and-aft depth of the recess 24 is such, and the fore-and-aft depth of the supplemental body is such, that the center of gravity of the overall putter head 10 is substantially rearwardly of the hitting face of the supplemental body.

It will be further noted that the toe 30 portion and the heel 32 portion of the head 10 are interconnected by the wall 33 at the rear of the head 10, thus providing that the center of gravity of the head 10 is rearwardly of the geometric center.

A further consideration of the components is that they comprise a block body 10 having a toe portion 30 and a heel portion 32, the toe portion 30 and heel portion 32 being inter-connected by a connector portion, shown here as including the wall 33 and a supplemental body 14; and the toe portion 30, the heel portion 32 and the connector portion, are so related such that the center of gravity of the putter head 10 is rearwardly of the geometric center.

Another consideration of the weight distribution concept is that the connector portion has a portion rearwardly of the geometric center of the club head which is of higher specific gravity than the portion of the connector portion forwardly of the geometric center of the club head, thereby providing that the center of gravity of the club head is rearwardly of the geometric center of the club head.

Also, as a specific feature of the novel putter head 10, the supplemental body 14 is of such a length, and the side faces 24 of the recess 22 are formed at such a distance apart from one another, that the length of the supplemental body 14 is about the same as the total length of the block body 12 outwardly of the supplemental body 14. The approximation of this relationship is shown in FIG. 1 by the toe portion 30 and the heel portion 32 of block body 12 being of a toal length "A" plus "B" about the same as the length "C" of the supplementary body 14.

Figure 3:
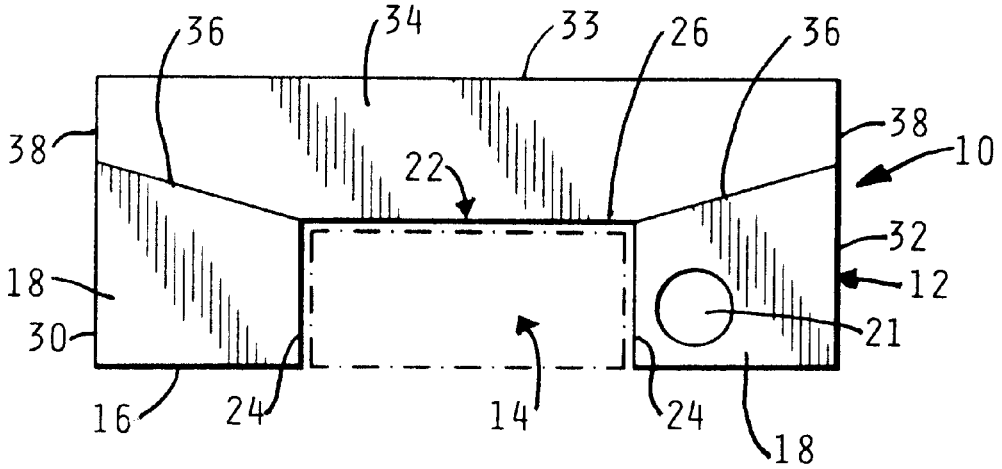
FIG. 3 is a plan view of the principal block body of the putter shown in FIGS. 1 and 2, and with the addition of a chain-line representation of the supplementary body nested or inlaid in the forwardly-facing recess of the principal block body.
Figure 4:
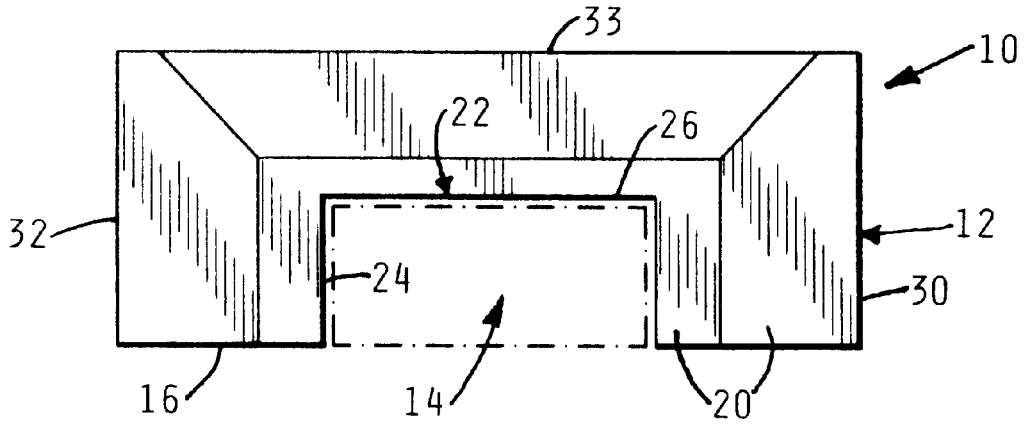
FIG. 4 is a bottom view of the assembly shown in FIG. 3, likewise showing the supplemental body in chain-lines.

For purposes of the Drawing, in FIGS. 3 and 4 the supplementary body 14 is shown as slightly less in length than the distance of which body faces 24 are apart, but it will be noted that the supplementary body 14 is desirably made of such a length that its engagement with the side faces 24 of block body 12 is operatively quite tight for purposes of tight retention, although of course other retaining means, such as epoxy glue may be employed.

Further features of the block body 12 are also to be noted, providing advantages individually and in combiantion.

Figure 5:
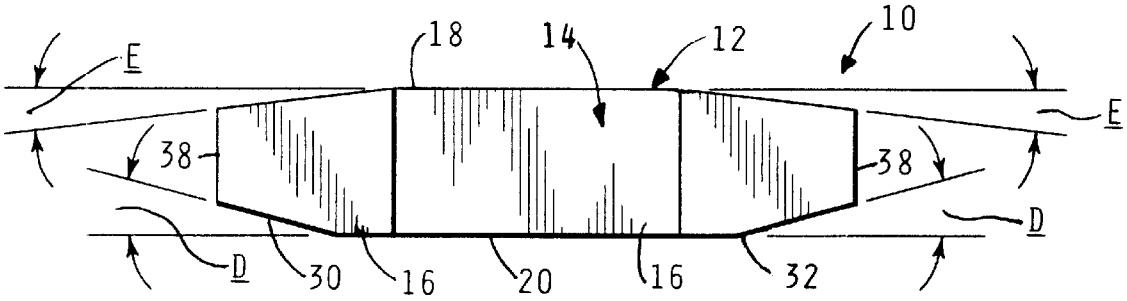
FIG. 5 is an elevation view of the putter body, showing the face thereof which faces forwardly, i.e., faces in the direction of the putter body in the making of a golf stroke, and with a schematic projection-line showing of the slanting upper and lower faces of the block body.
Figure 6:
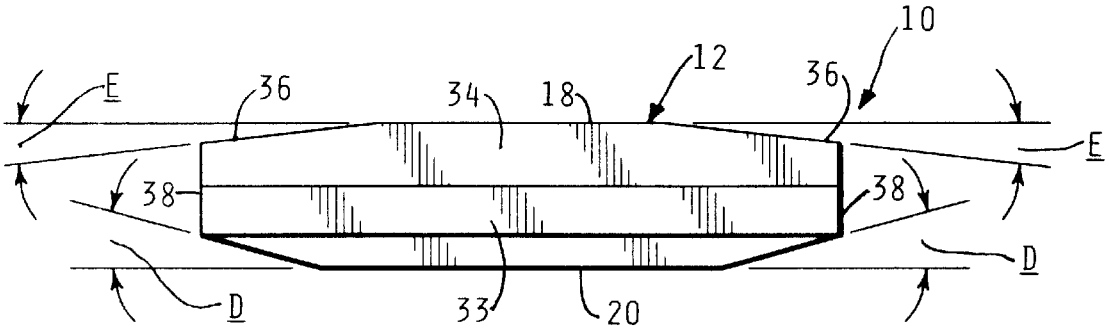
FIG. 6 is an elevation view of the rear face of the block body, likewise with projection lines showing the slant of those faces.
Figure 7:
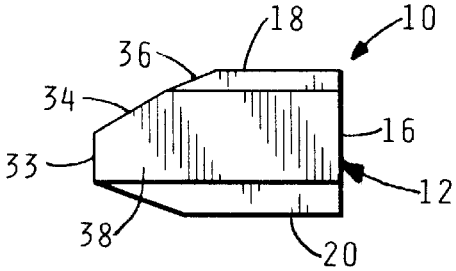
FIG. 7 is an end view of the block body shown in FIGS. 5 and 6.

Thus, noting particularly FIGS. 5 and 6, it will be seen that the sole 20 is champhered at its ends at an angle "D" outwardly at both ends of the block body sole 20, and the top face 18 is champhered at an angle "E" outwardly at both ends of the block body top face 18, and in which the angle "E" is about one-half the amount of angle "D".

Moreover, it will be noted that the rear portion of the block body 12 rearwardly of the wall 33 of the block body 12 which provides that the rearward top face of the block body 12 is a champhered face 34 which is at a disposition significantly non-coplanar with respect to the top face portion 18 of the side portions 38 of the block body 12.

This is such as to provide that the lines of intersection 36 of the champhered face 34 and the block body's top face 18 of its side portions 38 present non-colinear substantially straight lines 36 extending respectively from each of the side faces 38 of the block body 12 generally toward the center of the putter head 10; and thus provides a shot-alignment-encouraging motif without the addition of surface ornamentation therefor.

Another way of considering the non-coplanar provision which achieves the line of intersection 36 is to note that the adjacent portions of the champhered wall 34 and the side wall 18 are askew, as to at least one of the sides 38 of the block body 12, but preferably that askew relationship being adjacent both sides 38 of the block body 12, as is shown in the Drawings particularly as shown in FIG. 3.

If it is desired to have the development of a line 36 adjacent only one of the sides 38 of the block body 12, it is considered preferable that it be the line of intersection 36 adjacent the toe of the block body 12, that toe-adjacency being probably less likely to be obscured by the lower end of the club shaft.

IX. CONCLUSIONS AS TO INVENTIVE COMBINATION

It is thus seen that a golf putter head, formed according to the combination of inventive concepts and details herein set forth, provides novel concepts of a desirable and usefully advantageous article, yielding advantages which are and which provide special and particular advantages when used for a golf putter head.

In summary as to the nature of the overall club head's advantageous concepts, their novelty and inventive combination is shown by novel features of concept and construction shown here in advantageous combination and by the novel combinations hereof not only being different from all prior art known, even though many other putter heads of various assemblies have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of golf club putter heads for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of golf club putter heads.

The differences of concept and construction as specified herein yield advantages over the prior art; and the lack of this invention by the prior art, as an inventive combination, has been in spite of this invention's apparent simplicity of the construction once the concepts have been conceived, in spite of the advantages it would have given, and in spite of the availability of all of the materials to all persons of the entire world, and the invention's relatively non-technical and openly-visible nature.

Quite certainly this particular combination of prior art details as here presented in this overall combination has not been suggested by the prior art, this achievement in its particular details and utility being a substantial and advantageous departure from prior art, even though the prior art has had somewhat similar components separately for numbers of years.

Particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of golf putter head articles not achieving particular advantages here achieved by this combination.

Accordingly, it will thus be seen from the foregoing description of the invention according to the illustrative embodiment, considered with the accompanying Drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

What is claimed is:

1. A golf putter head, comprising, in combination:

a block body having faces including a front face, a top face, and a bottom sole, the block body having provided therein a recess formed in the block body, extending completely from the bottom sole to the top face of the block body, and with the block body formed to provide side faces of the recess and a forward-facing back face of the recess, and a supplemental body which is carried between the side faces of the recess, and extending forwardly from the back face of the recess completely forwardly of the block body to provide a hitting surface operatively engageable against the associated ball;

in a combination in which the sole is champhered at its ends at an angle "D" outwardly at both ends of the block body sole, and the top face is champhered at an angle "E" outwardly at both ends of the block body top face, and in which the angle "E" is about one-half the amount of angle "D".

2. A golf putter head, comprising, in combination:

a block body having faces including a front face, a top face, side portions and a bottom sole, the block body having provided therein a recess formed in the block body, extending completely from the bottom sole to the top face of the block body, and with the block body formed to provide side faces of the recess and a forward-facing back face of the recess, and a supplemental body which is carried between the side faces of the recess, and extending forwardly from the back face of the recess completely forwardly of the block body to provide a hitting surface operatively engageable against the associated ball;

in a combination in which a top portion of a rear portion of the block body, rearwardly of the portion of the block body which provides the forward-facing back face of the recess, is provided with a champher which provides that the top portion of the rear portion of the block body is a champhered face which is at a disposition significantly non-coplanar with respect to the top face of the side portions of the block body, such as to provide that the lines of intersection of said champhered face and the block body's top face of its side portions present non-colinear substantially straight lines extending respectively from each of the side faces of said block body generally toward the center of the putter head, thus providing a shot-alignment-encouraging motif without the addition of surface ornamentation therefor.

3. A golf putter head, comprising, in combination:

a block body having faces including a front face, a top face, and a bottom sole, the block body having provided therein a recess formed in the block body, extending completely from the bottom sole to the top face of the block body, and with the block body formed to provide side faces of the recess and a forward-facing back face of the recess, and a supplemental body which is carried between the side faces of the recess, and extending forwardly from the back face of the recess completely forwardly of the block body to provide a hitting surface operatively engageable against the associated ball;

in a combination in which a top portion of a rear portion of the block body, rearwardly of the portion of the block body which provides the forward-facing back face of the recess, is provided with a champher which provides that the top portion of the rear portion of the block body, adjacent at least one side of the block body, is a champhered face which is significantly askew with respect to the adjacent top face of that side portion of the block body, such as to provide that the line of intersection of said champhered face and that block body's top face of its side portion presents a substantially straight line extending from at least one of the side faces of said block body generally toward the center of the putter head, thus providing a shot-alignment-encouraging motif without the addition of surface ornamentation therefor.

4. A golf putter head as set forth in claim 3, in a combination in which the askew faces are adjacent the toe of the putter head.

5. A golf putter head, comprising, in combination:

a block body having faces including a front face, a top face, and a bottom sole, the block body having provided therein a recess formed in the block body, extending generally from the bottom sole to the top face of the block body, and with the block body formed to provide side faces of the recess and a forward-facing back face of the recess, and a supplemental body which is carried between the side faces of the recess, and extending forwardly from the back face of the recess completely forwardly of the block body to provide a hitting surface operatively engageable against the associated ball;

in a combination in which the sole is champhered at its ends at an angle "D" outwardly at both ends of the block body sole, and the top face is champhered at an angle "E" outwardly at both ends of the block body top face, and in which the angle "E" is about one-half the amount of angle "D".

6. A golf putter head, comprising, in combination:

a block body having faces including a front face, a top face, side portions and a bottom sole, the block body having provided therein a recess formed in the block body, extending generally from the bottom sole to the top face of the block body, and with the block body formed to provide side faces of the recess and a forward-facing back face of the recess, and a supplemental body which is carried between the side faces of the recess, and extending forwardly from the back face of the recess completely forwardly of the block body to provide a hitting surface operatively engageable against the associated ball;

in a combination in which a top portion of a rear portion of the block body, rearwardly of the portion of the block body which provides the forward-facing back face of the recess, is provided with a champher which provides that the top portion of the rear portion of the block body is a champhered face which is at a disposition significantly non-coplanar with respect to the top face of the side portions of the block body, such as to provide that the lines of intersection of said champhered face and the block body's top face of its side portions present non-colinear substantially straight lines extending respectively from each of the side faces of said block body generally toward the center of the putter head, thus providing a shot-alignment-encouraging motif without the addition of surface ornamentation therefor.

7. A golf putter head, comprising, in combination:

a block body having faces including a front face, a top face, side portions and a bottom sole, the block body having provided therein a recess formed in the block biddy, extending generally from the bottom sole to the top face of the block body, and with the block body formed to provide side faces of the recess and a forward-facing back face of the recess, and a supplemental body which is carried between the side faces of the recess, and extending forwardly from the back face of the recess completely forwardly of the block body to provide a hitting surface operatively engageable against the associated ball;

in a combination in which a top portion of a rear portion of the block body, rearwardly of the portion of the block body which provides the forward-facing back face of the recess, is provided with a champher which provides that the top portion of the rear portion of the block body, adjacent at least one side of the block body, is a champhered face which is significantly askew with respect to the adjacent top face of that side portion of the block body, such as to provide that the line of intersection of said champhered face and that block body's top face of its side portion presents a substantially straight line extending from at least one of the side faces of said block body generally toward the center of the putter head, thus providing a shot-alignment-encouraging motif without the addition of surface ornamentation therefor.

8. golf putter head as set forth in claim 7, in a combination in which the askew faces are adjacent the toe of the putter head.

9. The invention as set forth in claim 5, in a combination in which the center of gravity of the overall putter head is substantially rearwardly of the hitting surface of the supplemental body, and approximately midway between the heel and toe of the block body.

10. The invention as set forth in claim 5, in a combination in which the center of gravity of the putter head is rearwardly of the geometric center of the putter head and midway between the toe and heel of the putter head.

11. The invention as set forth in claim 6, in a combination in which the center of gravity of the overall putter head is substantially rearwardly of the hitting surface of the supplemental body, and approximately midway between the heel and toe of the block body.

12. The invention as set forth in claim 6, in a combination in which the center of gravity of the putter head is rearwardly of the geometric center of the putter head and midway between the toe and heel of the putter head.

13. The invention as set forth in claim 7, in a combination in which the center of gravity of the overall putter head is substantially rearwardly of the hitting surface of the supplemental body, and approximately midway between the heel and toe of the block body.

14. The invention as set forth in claim 7, in a combination in which the center of gravity of the putter head is rearwardly of the geometric center of the putter head and midway between the toe and heel of the putter head.

15. The invention as set forth in claim 8, in a combination in which the center of gravity of the overall putter head is substantially rearwardly of the hitting surface of the supplemental body, and approximately midway between the heel and toe of the block body and directly behind the center of the hitting surface of the supplemental body.

16. The invention as set forth in claim 8, in a combination in which the center of gravity of the putter head is rearwardly of the geometric center of the putter head and midway between the toe and heel of the putter head.

* * * * *